US009192825B2

(12) United States Patent
Nakamura

(10) Patent No.: US 9,192,825 B2
(45) Date of Patent: Nov. 24, 2015

(54) GOLF CLUB HEAD

(71) Applicant: Dunlop Sports Co. Ltd., Kobe-shi, Hyogo (JP)

(72) Inventor: Hirotaka Nakamura, Kobe (JP)

(73) Assignee: Dunlop Sports Co. Ltd., Kobe-shi (JP)

( * ) Notice: Subject to any disclaimer, the term of this patent is extended or adjusted under 35 U.S.C. 154(b) by 38 days.

(21) Appl. No.: 14/055,482

(22) Filed: Oct. 16, 2013

(65) Prior Publication Data

US 2014/0106903 A1 Apr. 17, 2014

(30) Foreign Application Priority Data

Oct. 17, 2012 (JP) ..... 2012-230148

(51) Int. Cl.
*A63B 53/04* (2015.01)
*A63B 59/00* (2015.01)

(52) U.S. Cl.
CPC ..... *A63B 53/0466* (2013.01); *A63B 59/0092* (2013.01); *A63B 2053/045* (2013.01); *A63B 2053/0408* (2013.01); *A63B 2053/0433* (2013.01); *A63B 2053/0437* (2013.01); *A63B 2053/0462* (2013.01); *A63B 2053/0491* (2013.01)

(58) Field of Classification Search
CPC ..... A63B 2053/045; A63B 2053/0454; A63B 2053/0462; A63B 2053/0433; A63B 2053/0408; A63B 2053/0491; A63B 2053/0437; A63B 53/0466
See application file for complete search history.

(56) References Cited

U.S. PATENT DOCUMENTS

| | | | | |
|---|---|---|---|---|
| 1,658,581 | A * | 2/1928 | Tobia | 473/346 |
| 6,244,976 | B1 * | 6/2001 | Murphy et al. | 473/305 |
| 7,056,228 | B2 * | 6/2006 | Beach et al. | 473/345 |
| 7,211,006 | B2 * | 5/2007 | Chang | 473/329 |
| 8,758,153 | B2 * | 6/2014 | Sargent et al. | 473/246 |
| 2004/0132544 | A1 * | 7/2004 | Doi | 473/345 |
| 2010/0048324 | A1 * | 2/2010 | Wada et al. | 473/346 |
| 2012/0077616 | A1 * | 3/2012 | Stites et al. | 473/318 |
| 2012/0289361 | A1 * | 11/2012 | Beach et al. | 473/338 |
| 2012/0322580 | A1 * | 12/2012 | Wada et al. | 473/346 |
| 2014/0187346 | A1 * | 7/2014 | Beno et al. | 473/332 |
| 2014/0274457 | A1 * | 9/2014 | Beach et al. | 473/335 |
| 2015/0011328 | A1 * | 1/2015 | Harbert et al. | 473/338 |

FOREIGN PATENT DOCUMENTS

| | | | |
|---|---|---|---|
| JP | 2009-166 | A | 1/2009 |
| JP | 2009-82291 | A | 4/2009 |
| JP | 2011-206242 | A | 10/2011 |
| JP | 2011-206243 | A | 10/2011 |

* cited by examiner

*Primary Examiner* — Stephen Blau
(74) *Attorney, Agent, or Firm* — Birch, Stewart, Kolasch & Birch, LLP

(57) ABSTRACT

A golf club head has a hollow and comprises a face portion having a club face for hitting a ball, a sole portion defining a bottom face of the club head, and a hosel into which a tip end of a golf club shaft is inserted. The hosel protrudes into the hollow. The sole portion is provided in its club face side with a thick ribbed part having a thickness of from 3.0 to 10.0 mm and extending in the toe-heel direction of the head. In the hollow, the ribbed part is connected to the hosel.

9 Claims, 9 Drawing Sheets

E1 section

GOLF CLUB HEAD

BACKGROUND OF THE INVENTION

The present invention relates to a golf club head, more particularly to a hollow golf club head provided in the hollow with a structure by which the force received by the face portion at impact can be effectively transmitted from the under side of the face portion to the hosel.

The following patent documents 1-4 disclose golf club heads having a hollow structure of which sole portion is provided in its club face side with a thick part extending in the toe-heel direction. Such sole portion has a large mass in order to lower the position of the center of gravity of the head.

In such golf club heads, however, the effect on the ball hitting feeling, of the thick part of the sole portion in relation to the hosel is not examined. Thus, the club heads disclosed in the patent documents 1-4 have room for improvement in the ball hitting feeling.

PATENT DOCUMENTS

Japanese Patent Application Publication Nos. 2009-166, 2011-206242, 2011-206243 and 2009-82291.

SUMMARY OF THE INVENTION

It is therefore, an object of the present invention to provide a golf club head, in which the ball hitting feeling is improved and at the same time the center of gravity of the head is lowered.

According to the present invention, a golf club head having a hollow therein comprises a face portion having a club face for hitting a ball, a sole portion continuing to a lower edge of the face portion and defining a bottom face of the club head, and a hosel portion comprising a hosel into which a tip end of a golf club shaft is inserted, wherein the hosel protrudes into the hollow, the sole portion is provided in its club face side with a thick ribbed part, the ribbed part swells toward the hollow, and has a thickness of from 3.0 to 10.0 mm, and the ribbed part is extended in the toe-heel direction of the head, and in the hollow, the ribbed part is connected to the hosel.

Therefore, owing to the thick ribbed part, the mass of the sole portion is increased, and the center of gravity can be lowered. Further, the thick ribbed part appropriately decreases vibrations of the face portion at impact to improve the hitting feeling.

As the ribbed part is connected to the hosel, the vibrations received by the face portion at impact are immediately transmitted from the under side of the face portion to the hosel through the ribbed part. Therefore, the golfer's hands can certainly feel the instantaneous feedback at impact through the club shaft, and the hitting feeling can be further improved.

The golf club head according to the present invention can be provided with the following additional features (1)-(6):

(1) the hosel comprises a tubular main portion and a bottom portion closing the lower end of the tubular main portion within the hollow, and the ribbed part is connected to the bottom portion of the hosel;

(2) the ribbed part is formed within a range of 3 to 15 mm from the undermentioned vertical plane VP toward the front direction and toward the back direction of the head;

(3) the ribbed part is separated from the back surface of the face portion facing the hollow;

(4) in the toe-heel direction, the maximum thickness of the ribbed part occurs at a vertical plane 1V passing through the center of gravity of the head perpendicularly to the undermentioned vertical plane VP:

(5) the thickness of the ribbed part is gradually decreased toward the rear side of the club head; and (6) a hollow structure comprising a main body including the hosel portion and having a front opening and a bottom opening, a face member covering the front opening to form at least part of the face portion, and a sole member covering the bottom opening to form at least part of the sole portion, wherein the specific gravity D1 of the main body is more than the specific gravity D2 of the face member and less than the specific gravity D3 of the sole member.

DEFINITIONS

In this application including the description and claims, dimensions, positions, directions and the like relating to the club head refer to those under a standard state of the club head unless otherwise noted.

Here, the standard state of the club head is such that the club head is set on a horizontal plane HP so that the axis of the club shaft (not shown) is inclined at the lie angle alpha while keeping the axis on a vertical plane VP, and the club face forms its loft angle (real loft angle, more than zero) at the sweet spot SS with respect to the horizontal plane HP, and the club face angle is zero. Incidentally, in the case of the club head alone, the center line of the shaft inserting hole can be used instead of the axis of the club shaft.

"Front-back direction" is a direction FR parallel with a straight line N projected on the horizontal plane HP, wherein the straight line N is drawn normally to the club face passing through the center of gravity of the club head.

"Toe-heel direction" is a direction TH parallel with the horizontal plane HP and perpendicular to the front-back direction.

"Sweet spot" is the point SS of intersection between the club face and the straight line N drawn normally to the club face 2 passing the center of gravity G of the head.

"Edge of Club Face": If the peripheral edge 2A of the club face 2 (including the upper edge 2*a*, toe-side edge 2*c*, lower edge 2*b* and heel-side edge 2*d*) is unclear due to smooth change in the curvature of the club face 2, a virtual edge line (Pe) which is defined based on the curvature change, is used instead as follows. As shown in FIGS. 3(*a*) and 3(*b*), in each cutting plane E1, E2 - - - including the straight line N extending between the sweet spot SS and the center of gravity G, a point Pe at which the radius (r) of curvature of the profile line Lf of the face portion first becomes under 200 mm in the course from the center SS to the periphery of the club face is determined. Then, the virtual edge line is defined as a locus of the points Pe.

DESCRIPTION OF THE PREFERRED EMBODIMENTS

Embodiments of the present invention will now be described in detail in conjunction with accompanying drawings.

The present invention is suitably applied to wood-type golf club heads including at least driver (#1), brassie (#2), spoon (#3), baffy (#4) and cleek (#5) and heads having similar shapes thereto, more suitably applied to fairway woods for example having a loft angle of not less than 14 degrees, in particular, not less than 16 degrees.

Figure 1:
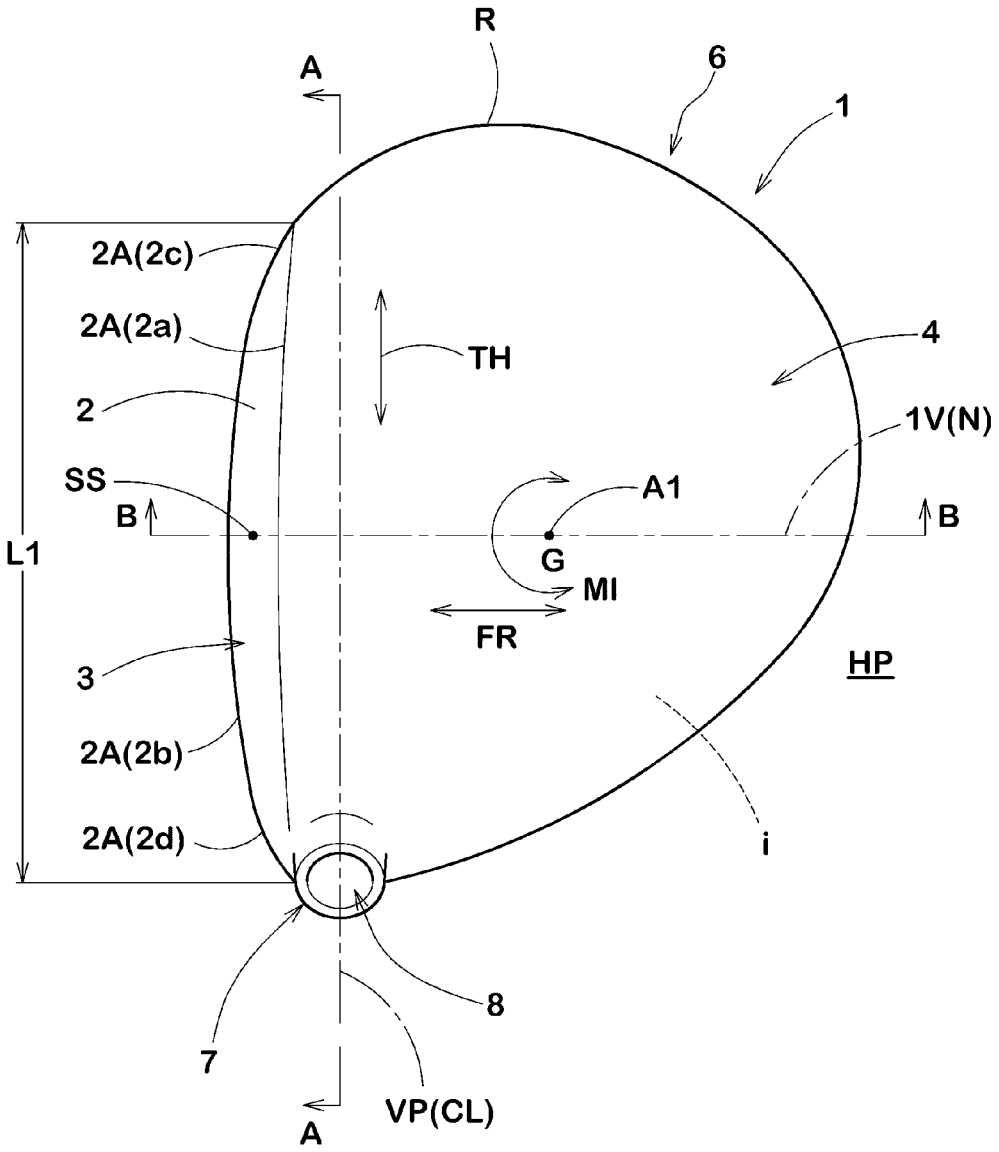
FIG. 1 is a top view of a golf club head as an embodiment of the present invention.
Figure 2:
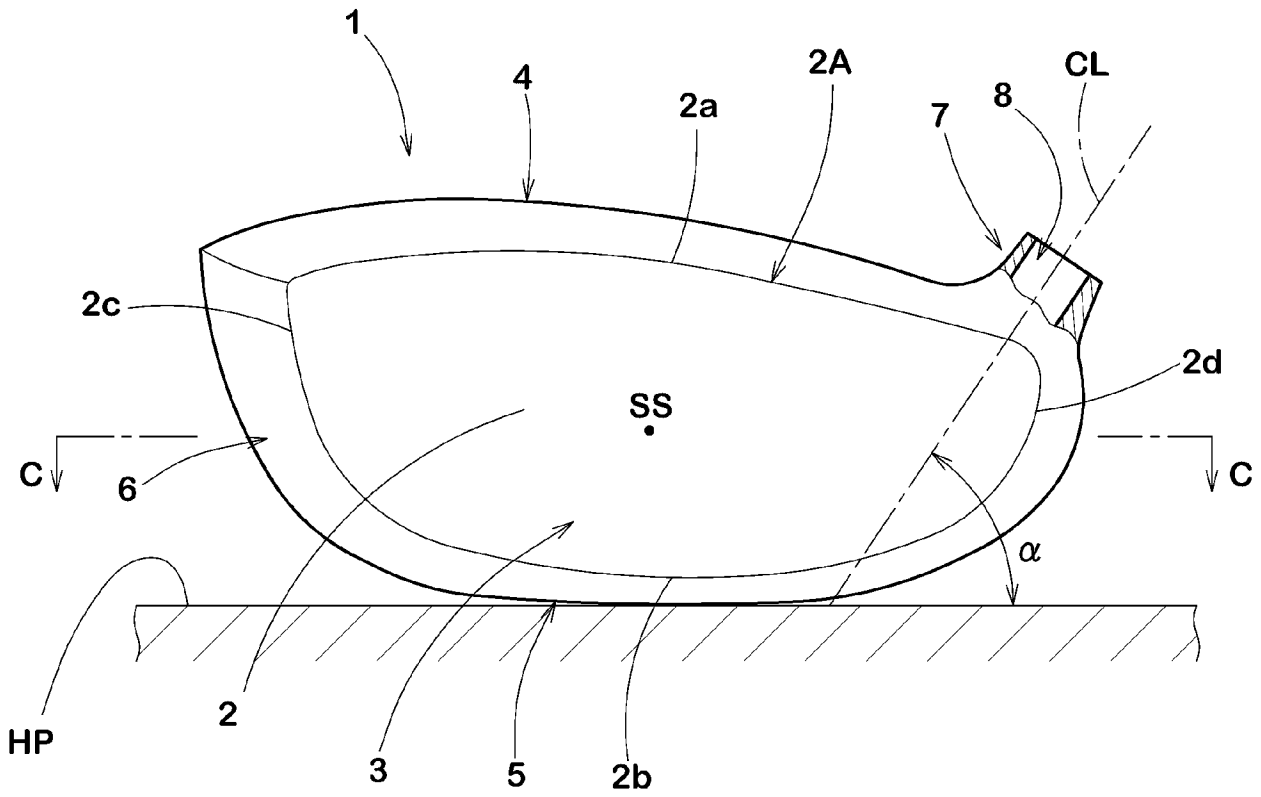
FIG. 2 is a front view thereof.
Figure 3A:
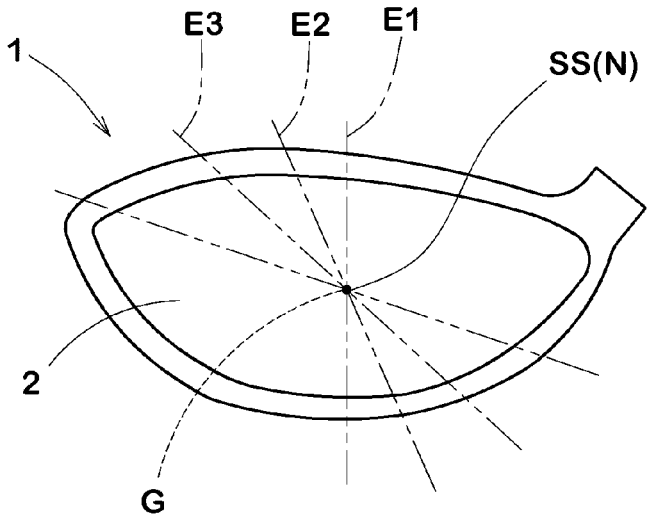
FIGS. 3(*a*) and 3(*b*) are a front view and a cross sectional view of a golf club head for explaining the peripheral edge of the club face.
Figure 3B:
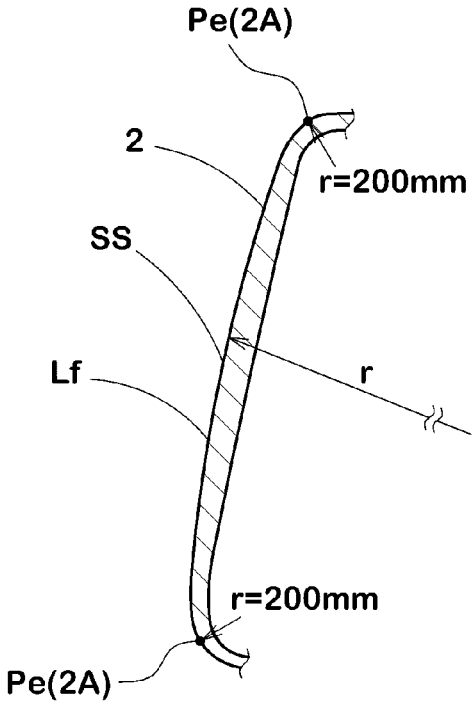

FIGS. 1 and 2 shows a golf club head 1 as an embodiment of the present invention under its standard state, which is designed for such a fairway wood.

The golf club head 1 comprises a face portion 3, a crown portion 4, a sole portion 5, a side portion 6 and a hosel portion 7.

The face portion 3 has a club face 2 for hitting a ball. The crown portion 4 continues to the upper edge 2*a* of the club face 2 and forms the top face of the club head.

The sole portion 5 continues to the lower edge 2*b* of the club face 2 and forms the bottom face of the club head.

The side portion 6 connects between the crown portion 4 and the sole portion 5 and extends from the toe-side edge 2*c* of the club face 2 to the heel-side edge 2*d* of the club face 2 through the back side of the club head.

The hosel portion 7 is formed in a heel side of the crown portion 4.

The hosel portion 7 comprises a hosel 8 which is tubular and into which the tip end of a golf club shaft (not shown) is inserted.

The golf club head 1 has a hollow i (in this embodiment a substantially closed hollow i).

When the club head 1 is designed for a driver, the volume thereof is preferably not less than 350 cc, more preferably not less than 420 cc.

When the club head 1 is designed for a fairway wood, the volume thereof is preferably not less than 90 cc, more preferably not less than 120 cc.

Such head volume can effectively increase the moment of inertia MI and helps to deepen the center of gravity of the head.

If the head volume is excessively increased, the head weight is unfavorably increased and the swing balance is deteriorated. Further, there is a possibility that the golf rules are violated. Therefore, the volume of the club head 1 is limited not to exceed 460 cc.

It is preferable that the moment of inertia MI of the head 1 around a vertical axis A1 passing through the center G of gravity of the head is limited as follows.

When the club head 1 is designed for a driver, it is preferable that the moment of inertia MI is 3500 to 5000 g sq.cm.

When the club head 1 is designed for a fairway wood, it is preferable that the moment of inertia MI is 2600 to 2800 g sq.cm. To comply with the golf rules, the moment of inertia MI is limited not to exceed 5900 g sq.cm.

If the moment of inertia MI is excessively large, the horizontal gear effect decreases and it becomes difficult to obtain desired sidespin. Therefore, when the ball hitting position is off-centered toward the toe or heel, the ball can not return to the target trajectory. Thus, the directional stability of the hit balls is deteriorated.

If the moment of inertia MI is excessively small, when the ball hitting position is off-centered toward the toe or heel, the club head is easily moved toward the right or left. Thus, the directional stability of the hit balls is deteriorated.

When the club head 1 is designed for a driver, the mass of the club head 1 is preferably not less than 160 g, more preferably not less than 170 g, but not more than 220 g, more preferably not more than 210 g.

When the club head 1 is designed for a fairway wood, the mass of the club head 1 is preferably not less than 180 g, more preferably not less than 190 g, but not more than 250 g, more preferably not more than 240 g.

If the mass of the club head 1 is excessively small, there is a possibility that the durability is deteriorated.

If the mass of the club head 1 is excessively large, there is a possibility that the swing balance and the directional stability of the hit ball are deteriorated, and the flying distance is decreased.

In this embodiment, the club head 1 is made up of a face member 1A forming at least part of the face portion 3 (in this embodiment the entirety), a sole member 1B forming at least part of the sole portion 5, and a main body 1C to which the face member 1A and the sole member 1B are attached.

Figure 4:
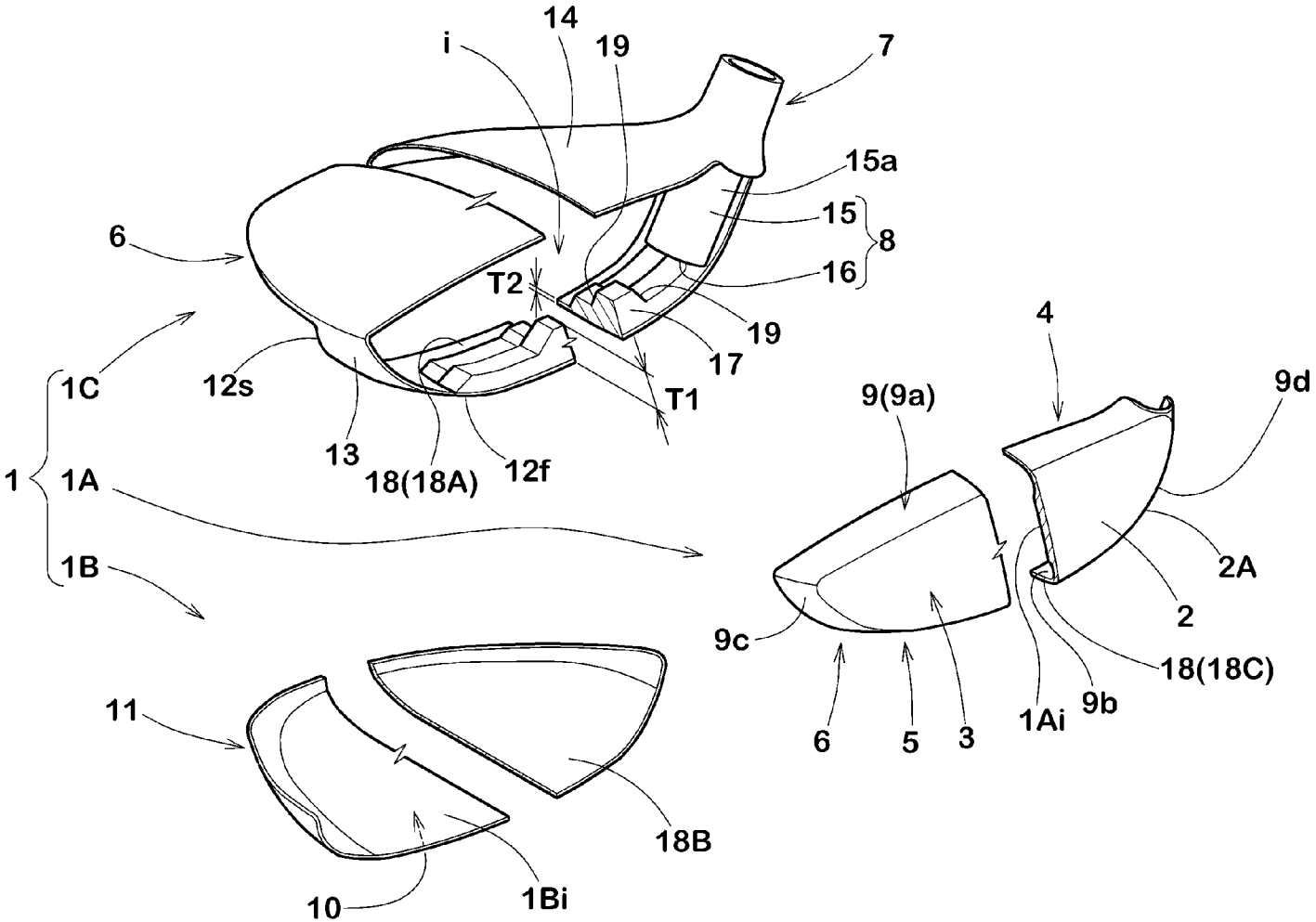
FIG. 4 is an exploded perspective view of the golf club head shown in FIG. 1.

As shown in FIG. 4, the face member 1A in this example includes the face portion 3 and a turnback 9 extending backward from the peripheral edge of the face portion 3.

The turnback 9 includes: a crown-side turnback 9*a* forming a front part of the crown portion 4; a sole-side turnback 9*b* forming a front part of the sole portion 5; a toe-side turnback 9*c* forming a front part of the side portion 6 on the toe side; and a heel-side turnback 9*d* forming a front part of the side portion 6 on the heel-side. Such turnbacks 9*a*-9*d* extend continuously around the club face 2 excepting the hosel portion 7.

The face member 1A is made of a metal material having a high specific strength such as maraging steel, titanium, titanium alloy, magnesium alloy and aluminum alloy in order to secure durability.

The sole member 1B includes a sole rear part 10 forming the remaining rear part of the sole portion 5, and a turnup 11 extending upward from the peripheral edge of the sole rear part 10 excepting the front edge, and forming a lower part of the side portion 6. The sole member 1B is not limited to such configuration. For example, the sole member 1B may be made up of the sole portion 5 only.

The sole member 1B is made of a metal material having a high specific gravity such as stainless alloy, maraging steel and tungsten alloy in order to lower the position of the center of gravity of the club head 1.

Figure 5:
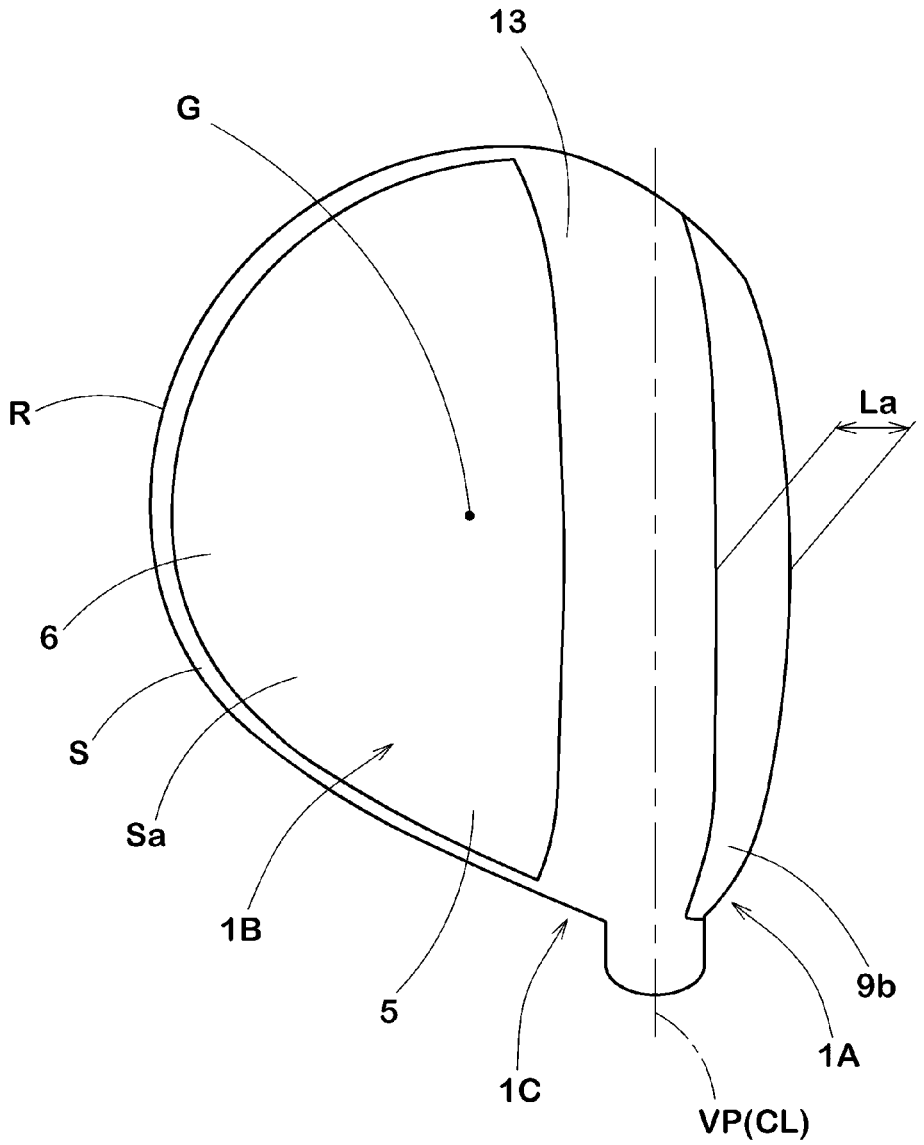
FIG. 5 is a bottom view of the golf club head shown in FIG. 1

In this embodiment, as shown in FIG. 5, the sole member 1B is positioned on the rear side of the center line CL of the club shaft and (or the vertical plane VP), and the sole member 1B has a semicircular shape whose contour extending along the contour R of the club head 1 within the contour R in order to appropriately increase the moment of inertia MI and to lower the center of the gravity of the club head, In FIG. 5, the area Sa of the bottom face of the sole member 1B is preferably not less than 20%, more preferably not less than 30%, but not more than 70%, more preferably not more than 60% of the area S surrounded by the contour R of the club head 1. Thus, each area Sa and S is the area projected on the horizontal plane HP.

The main body 1C in this embodiment corresponds to the club head 1 from which the face member 1A and the sole member 1B are excluded.

The main body 1C has a front opening 12*f* covered by the face member 1A and a bottom opening 12*s* covered by the sole member 1B. The main body 1C integrally includes the above-mentioned hosel portion 7, the remaining major rear section 14 of the crown portion 4, and a middle section 13 in the front-back direction, of the sole portion 5 formed between the lower edge of the front opening 12*f* and the front edge of the bottom opening 12*s*.

The main body 1C is made of a stainless alloy, maraging steel, titanium or titanium alloy in order to increase the head volume and to optimize the moment of inertia MI.

It is preferable that the specific gravity D1 of the main body 1C is more than the specific gravity D2 of the face member 1A and less than the specific gravity D3 of the sole member 1B (namely, D3>D1>D2) in order to lower the position of the center of gravity of the club head 1 while improving the hitting feeling.

For example, the face member 1A is made of a titanium (Ti) alloy having a specific gravity of 4.6. The sole member 1B is made of a tungsten (W) alloy having a specific gravity of 8.3. The main body 1C is made of a stainless alloy having a specific gravity of 7.8.

The edge of the face member 1A is welded to the edge of the front opening 12*f* of the main body 1C.

In this embodiment, due to the turnback 9, the welding position is apart backward from the peripheral edge 2A of the club face 2.

In the bottom view of the head as shown in FIG. 5, the maximum dimension La in the front-back direction, of the sole-side turnback 9*b* is not more than 15 mm, preferably not more than 13 mm.

If the maximum dimension La is becomes increased, it becomes difficult for the undermentioned ribbed part 17 to effectively receive the force or vibrations at impact from the face portion.

In view of the durability of the weld joint, the maximum dimension La is preferably not less than 5 mm, more preferably not less than 7 mm.

Aside from such welding technique, the face member 1A may be fixed to the main body 1C by the use of a brazing technique.

Similarly, the edge of the sole member 1B is fixed to the edge of the bottom opening 12*s* of the main body 1C by welding, brazing or the like.

Figure 6:
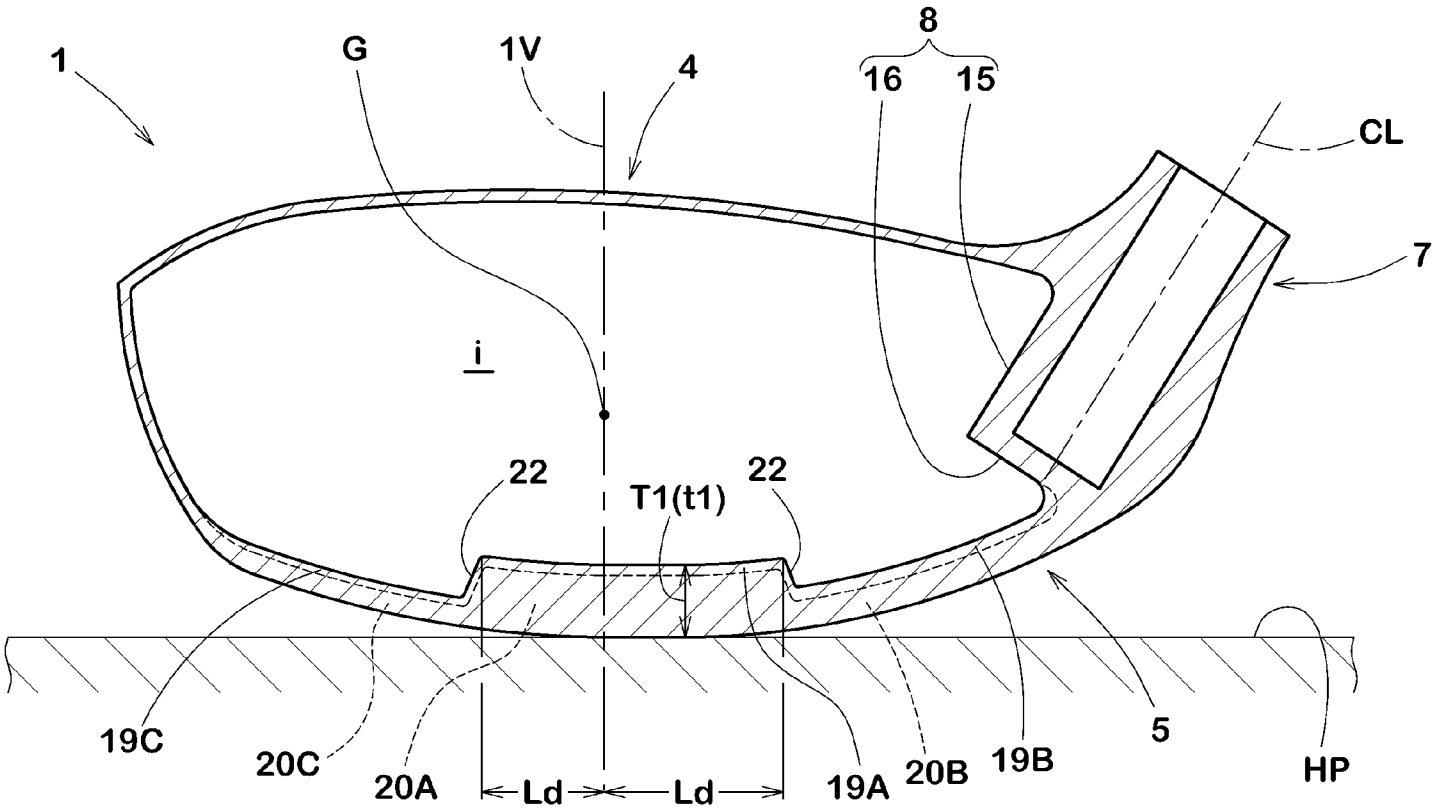
FIG. 6 is a cross sectional view taken along line A-A of FIG. 1.

As shown in FIG. 4 and FIG. 6, the hosel 8 comprises a main portion 15 which is tubular and extends into the hollow i and a bottom portion 16 closing the lower end of the hole of the main portion 15 within the hollow i.

A heel-side part of the side face 15*a* of the main portion 15 is united with a heel-side part of the inner surface of the main body 1C in order to increase the rigidity of the hosel portion 7 and the heel and to thereby improve the directional stability of the hit balls.

The sole portion 5 is provided in its club face side with a thicker ribbed part 17 extending in the toe-heel direction and swelling toward the hollow i.

The ribbed part 17 has a thickness T1 in a range of not less than 3.0 mm, preferably not less than 3.5 mm, but not more than 10.0 mm. preferably not more than 7.5 mm.

The sole portion 5 therefore, has a resultant thin part 18 whose thickness T2 is less than 3.0 mm.

The ribbed part 17 increases the mass of the sole portion 5 and helps to lower the position of the center of gravity of the head. The ribbed part 17 appropriately decreases vibrations of the face portion at impact to improve the hitting feeling. If the thickness T1 of the ribbed part 17 is less than 3.0 mm, it becomes difficult to lower the position of the center of gravity of the head. If the thickness T1 of the ribbed part 17 is more than 10.0 mm, the position of the center of gravity of the sole portion 5 becomes high, therefore, it is difficult to lower the position of the center of gravity of the head.

The ribbed part 17 is formed in only the above-mentioned middle section 13 of the sole portion 5.

Therefore, the thin part 18 includes a thin part 18A formed by the main body 1C on the rear side of the ribbed part 17, a thin part 18B formed by the sole member 1B, and a thin part 18C formed by the sole-side turnback 9*b* of the face member 1A.

In order to secure the rigidity of the club head 1, the thickness T2 of the thin parts 18 is preferably not less than 0.8 mm.

In this embodiment, the thickness of the crown portion 4 is less than 3 mm in order to increase the head volume and the moment of inertia MI.

The ribbed part 17 continues to the hosel 8 (in this example, to the bottom portion 16) within the hollow i, namely, in the inside of the head.

Therefore, vibrations of the face portion at impact are immediately transmitted from the under side of the face portion to the hosel through the ribbed part. Accordingly, the golfer's hands can certainly feel the instantaneous feedback at impact through the club shaft, and the hitting feeling can be improved.

Figure 7:
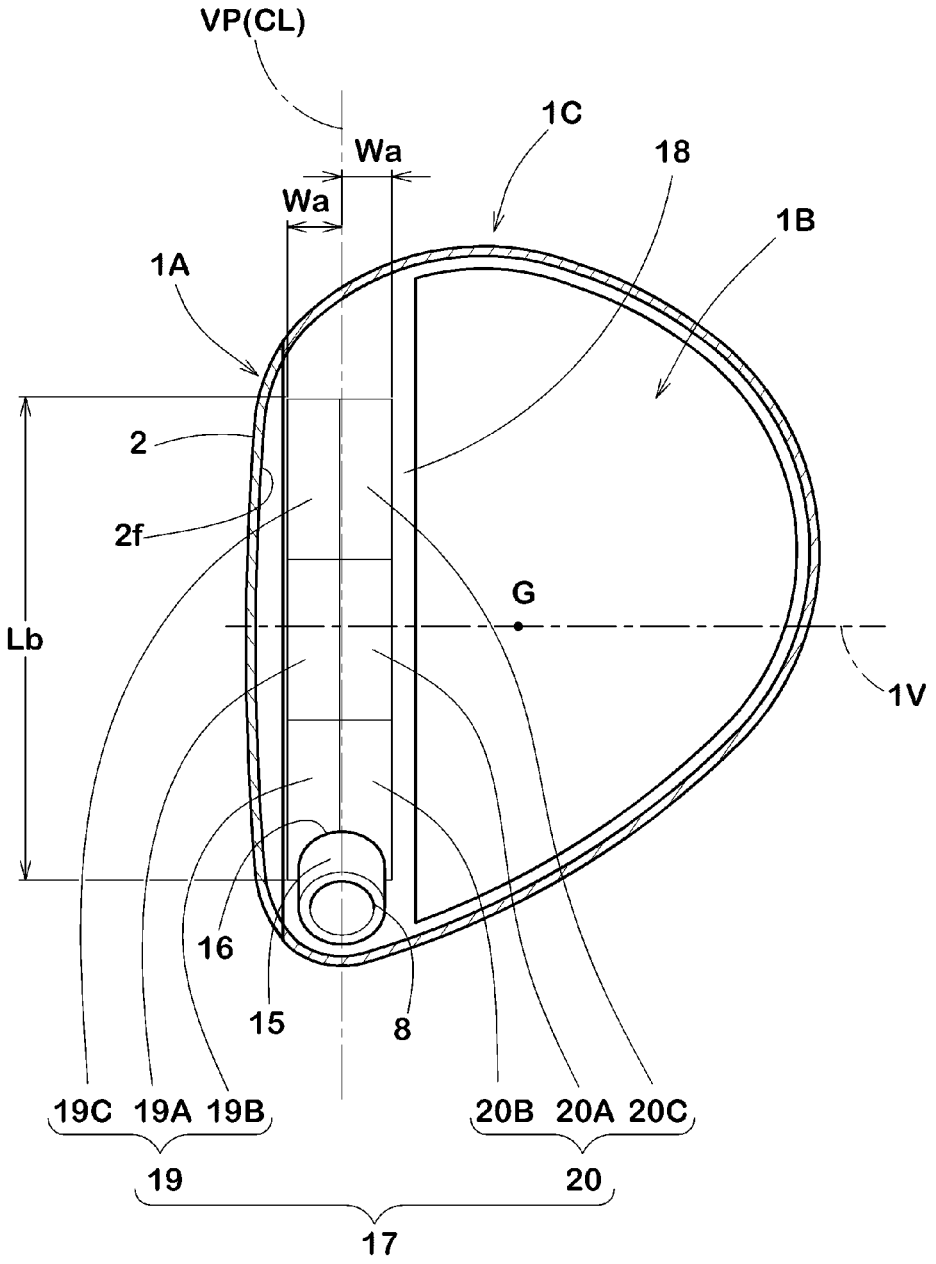
FIG. 7 is a cross sectional view taken along line C-C of FIG. 2.

FIG. 7 shows the top view of the ribbed part 17 in this embodiment.

Preferably, the ribbed part 17 extends a certain distance Wa toward the front direction and also a certain distance Wa toward the back direction, both from the vertical plane VP.

Each distance Wa is preferably not less than 3 mm, more preferably not less than 5 mm, but not more than 15 mm, more preferably not more than 13 mm in order to lower the position of the center of gravity while controlling an excessive increase of the mass of the club head 1.

The ribbed part 17 extends in the toe-heel direction. The length Lb of the ribbed part 17 in the toe-heel direction is preferably not less than 50%, more preferably not less than 60%, but not more than 100%, more preferably not more than 90% of the length L1 (not shown) of the peripheral edge 2A of the club face measured in the toe-heel direction in order that the ribbed part 17 can effectively receive the vibrations of the face portion, and increase the moment of inertia MI.

Figure 8:
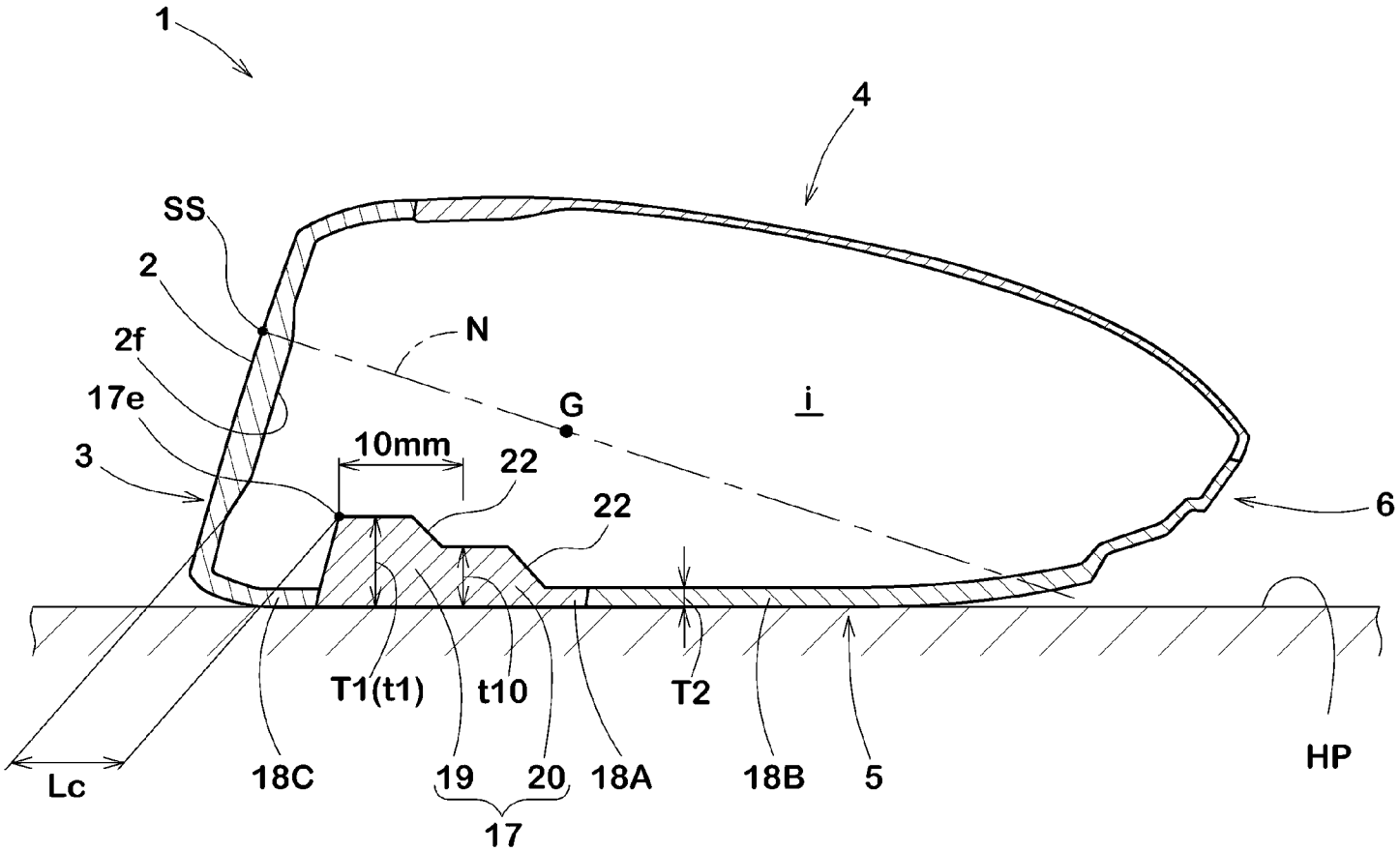
FIG. 8 is a cross sectional view taken along line B-B of FIG. 1.

FIG. 8 is a cross sectional view of the head taken along a vertical plane 1V which passes through the center G of gravity of the head perpendicularly to the vertical plane VP including the center line CL of the club shaft.

As shown, the ribbed part 17 is separated from the back surface 2*f* of the face portion 3 facing the hollow i in order to prevent the ribbed part 17 from contacting with the back surface 2*f* of the face portion deformed at impact and thereby to avoid deteriorations of the hitting feeling and rebound performance. Therefore, the distance Lc in the front-back direction between the back surface 2*f* and the thick ribbed part 17 is set to be not less than 3 mm, preferably not less than 5 mm.

If the distance Lc becomes large, it becomes difficult to effectively receive the vibrations of the face portion. Further, the center of gravity of the head shifts backward, and there is a possibility that the position of the sweet spot SS becomes high. Therefore, the distance Lc is set to be not more than 15 mm, preferably not more than 13 mm.

Along the entire length of the ribbed part 17 in the toe-heel direction, the ribbed part 17 is separated from the back surface 2*f* by the above distance Lc irrespective of constant or variable. In this embodiment, as shown in FIG. 7, the distance Lc is substantially constant along the entire length. The front edge of the ribbed part 17 is substantially straight and parallel with the toe-heel direction. The rear edge of the ribbed part 17 is also substantially straight and parallel with the toe-heel direction. Therefore, the ribbed part 17 has a substantially rectangular shape in its top view.

As shown in FIG. 8, the thickness of the ribbed part 17 is gradually (in this embodiment, steppedly) decreased towards the rear side of the club head.

It is not essentially but preferable that, when the thickness of the ribbed part 17 is measured in the above-mentioned vertical plane 1V, the thickness t10 measured at a position 10 mm backward from the front end 17*e* of the part having the maximum thickness t1 is 1 to 6 mm less than the maximum thickness t1. Such configuration may control an excessive increase of the mass of the club head 1.

It is preferable that, in the toe-heel direction, the maximum thickness T1 of the ribbed part 17 occurs at the vertical plane 1V, namely, at the position in the toe-heel direction corresponding to that of the center G of gravity of the head, and as shown in FIG. 6, the part having the maximum thickness extends a certain distance Ld toward the toe and a certain distance Ld toward the heel, both from the vertical plane 1V. This helps to lower the center G of gravity of the head. Preferably, each distance Ld is set in a range of not less than 15 mm, more preferably not less than 17 mm, but not more than 35 mm, more preferably not more than 30 mm in the toe-heel direction in order to appropriately reduce vibrations of the face portion occurring near the sweet spot SS at impact by effectively receiving and transmitting the vibration energy toward the hosel, without excessively increasing the mass of the club head 1.

In order to effectively derive such advantageous function, the ribbed part 17 is made up of a front portion 19 and a rear portion 20 as shown in FIGS. 4, 6 and 7.

The front portion 19 is made up of: a mid front portion 19A formed in the middle in the toe-heel direction and having the maximum thickness; a heel-side front portion 19B formed on the heel-side of the mid front portion 19A and having a thickness less than the mid front portion 19A; and a toe-side front portion 19C formed on the toe-side of the mid front portion 19A and having a thickness less than the mid front portion 19A.

The rear portion 20 is made up of: a mid rear portion 20A formed in the middle in the toe-heel direction and having the maximum thickness of the rear portion 20; a heel-side rear portion 20B formed on the heel-side of the mid rear portion 20A and having a thickness less than the mid rear portion 20A; and a toe-side rear portion 20C formed on the toe-side of the mid rear portion 20A and having a thickness less than the mid rear portion 20A.

Between the portions 19A-19C and 20A-20C of the ribbed part 17 and the adjacent thin part 18, there are preferably formed slant portions 22 whose thickness is continuously varied in order to avoid the formation of stepped difference in the rigidity.

Figure 9:
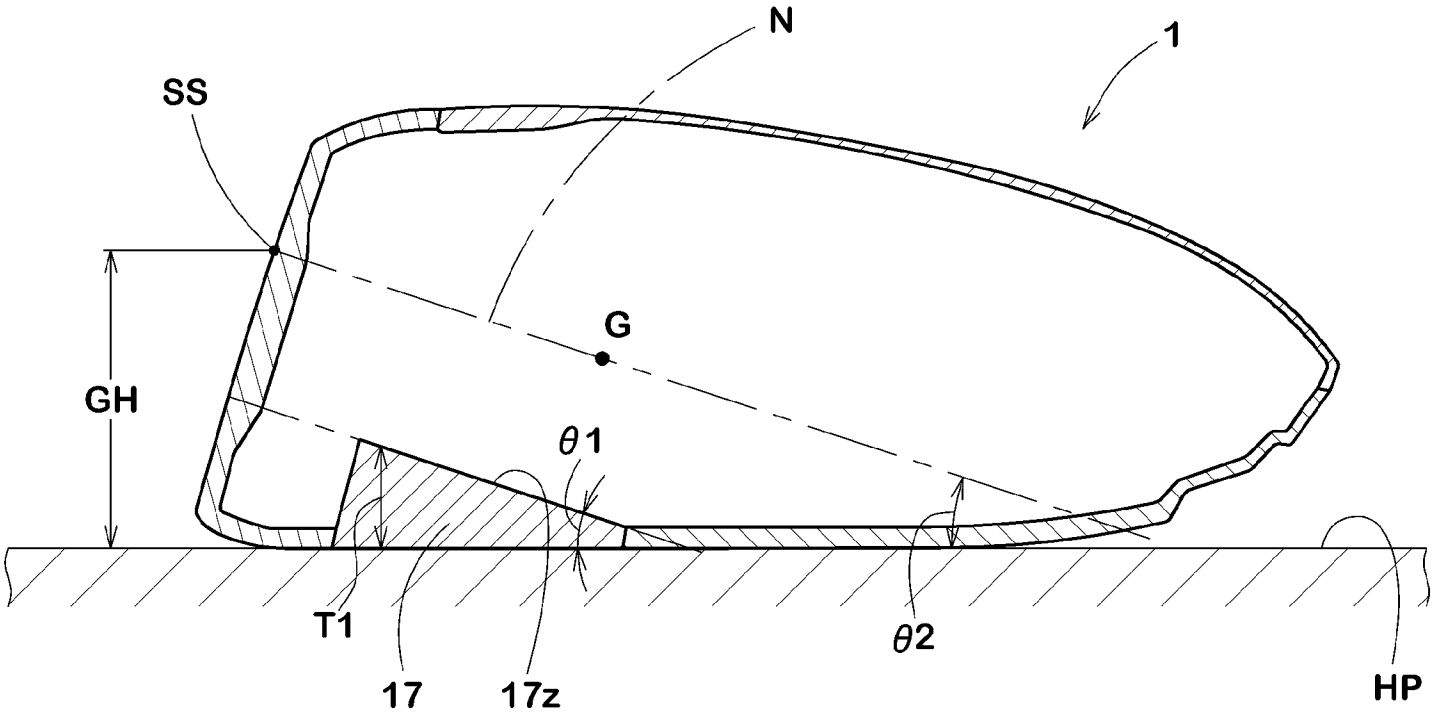
FIG. 9 is a cross sectional view (corresponding to FIG. 8) of a golf club head as another embodiment of the present invention.

FIG. 9 shows a club head 1 as another embodiment of the present invention in which the thickness T1 of the ribbed part 17 is gradually, linearly decreased toward the rear side of the club head. Other aspects are the same as the former embodiment. In this embodiment, it is preferable that, when measured in the vertical plane 1V, the difference $|\theta 1-\theta 2|$ between the angle θ1 between the upper surface 17*z* of the ribbed part 17 and the horizontal plane HP and the angle θ2 between the normal line N passing through the center G of gravity of the head and the horizontal plane HP, is not more than 10 degrees, more preferably not more than 5 degrees.

Such ribbed part 17 can shift forward the center G of gravity of the head to lower the height GH of the sweet spot SS and thereby to control backspin.

Thus, in the above-mentioned embodiments, the ribbed part 17 extends along the inner surface of the hollow structure from the bottom portion 16 of the hosel 8 to the distance Ld toward the toe of at least 15 mm, while keeping the thickness T1 of at least 3.0 mm, and the forward extent (corresponding to the forward distance Wa) of at least 3 mm from the vertical plane VP and the backward extent (corresponding to the backward distance Wa) of at least 3 mm from the vertical plane VP.

While description has been made of particularly preferable embodiments of the present invention, the illustrated embodiments should not be construed as to limit the scope of the present invention; various modifications are possible without departing from the scope of the present invention.

Comparison Tests

Based on the structure shown in FIG. 4, golf club heads were produced experimentally and tested for the rebound performance and hitting feeling. All of the club heads had the same specifications except for those shown in Table 1.

Common specifications are as follows:

mass of club head: 215 g
volume of club head: 161 cc
loft angle: 18 degrees
lie angle: 59 degrees
thickness of club head: 35 mm
height of club face: 29 mm
max. length L1 of club face: 87 mm
length Lb of ribbed part: 70 mm
distance Ld+Ld: 30 mm
distance Wa+Wa: 16 mm
thickness t3 of toe-side front portion: 5.5 mm
thickness t4 of mid rear portion: 4.5 mm
thickness t5 of heel-side rear portion: 3.0 mm
thickness t6 of toe-side rear portion: 2.5 mm
area ratio Sa/S: 0.55
material of main body: stainless alloy (CUSTOM450, specific gravity 7.8)
materials of face member and sole member:
Ti alloy: Ti6-22-22S (specific gravity: 4.6)
W alloy: W—Ni (specific gravity: 8.3)
stainless alloy: CUSTOM450 (specific gravity: 7.8)

In order that the club heads had the identical mass, the thickness of each member was uniform changed.

<Rebound Performance Test>

According to the "Procedure for Measuring the Velocity Ratio of a Club Head for Conformance to Rule 4-1e, Appendix II, Revision 2 (Feb. 8, 1999), United States Golf Association", the restitution coefficient was obtained with respect to three positions (the sweet spot SS, a toe-side position spaced apart 20 mm from the sweet spot toward the toe, and a heel-side position spaced apart 20 mm from the sweet spot toward the heel). The average value of the three measurements is shown in Table 1. The value closer to 0.83 without exceeding the upper limit 0.83 in the golf rules is better.

<Hitting Feeling Test>

Each head was attached to a FRP shaft (Dunlop Sports Co. Ltd., "MP-700", Flex R) to make a 42-inch #5 wood. Twenty golfers whose handicaps ranged from 5 to 15 hit three-piece balls (Dunlop Sports Co. Ltd., "XXIO LX") ten times per club, and it was checked whether the vibration felt by the golfer's hands was solid and such hitting feeling was evaluated into five ranks. The results are shown in Table 1, wherein the higher rank number is better.

<Sweet Spot Height>

The smaller the value, the lower the center of gravity of the head.

<Moment of Inertia>

The moment of inertia MI was measured by the use of Moment of inertia measuring instrument (INERTIA DYNAMICS Inc, MODEL No. 005-002). The values in a range of from 2600 to 2800 g sq.cm are better because the motions of the club head when missed shot are small.

TABLE 1

| Club head | Ex. 1 | Ref. 1 | Ex. 2 | Ex. 3 | Ref. 2 | Ex. 4 |
|---|---|---|---|---|---|---|
| mid front portion thickness t1 (mm) | 7.0 | 2.5 | 3.0 | 10.0 | 11.0 | 7.0 |
| heel-side front portion thickness t2 (mm) | 4.5 | 2.5 | 3.0 | 7.0 | 4.5 | 4.5 |
| thickness t10 (mm) | 4.5 | 2.5 | 2.0 | 4.0 | 4.5 | 4.5 |
| t1 − t10 (mm) | 2.5 | 0 | 1.0 | 6.0 | 6.5 | 2.5 |
| max dimension La (mm) *1 | 10 | 10 | 10 | 10 | 10 | 3 |
| face member material | Ti alloy | Ti alloy | Ti alloy | Ti alloy | Ti alloy | Ti alloy |
| sole membermaterial | W alloy | W alloy | W alloy | W alloy | W alloy | W alloy |
| sweet spot height (mm) | 22.0 | 23.0 | 22.5 | 21.6 | 21.9 | 21.6 |
| moment of inertia MI (g sq · cm) | 2700 | 2800 | 2800 | 2600 | 2550 | 2700 |
| restitution coefficient | 0.798 | 0.798 | 0.798 | 0.798 | 0.798 | 0.795 |
| hitting feeling | 5 | 1 | 3 | 4 | 3 | 4 |

| Club head | Ex. 5 | Ex. 6 | Ex. 7 | Ex. 8 | Ex. 9 |
|---|---|---|---|---|---|
| mid front portion thickness t1 (mm) | 7.0 | 7.0 | 7.0 | 7.0 | 7.0 |
| heel-side front portion thickness t2 (mm) | 4.5 | 4.5 | 4.5 | 4.5 | 4.5 |
| thickness t10 (mm) | 4.5 | 4.5 | 4.5 | 4.5 | 4.5 |
| t1 − t10 (mm) | 2.5 | 2.5 | 2.5 | 2.5 | 2.5 |
| max dimension La (mm) *1 | 5 | 15 | 17 | 10 | 10 |
| face member material | Ti alloy | Ti alloy | Ti alloy | Ti alloy | stainless alloy |
| sole membermaterial | W alloy | W alloy | W alloy | stainless alloy | W alloy |
| sweet spot height (mm) | 21.8 | 22.2 | 22.3 | 22.6 | 22.7 |
| moment of inertia MI (g sq · cm) | 2700 | 2700 | 2700 | 2650 | 2650 |
| restitution coefficient | 0.796 | 0.800 | 0.801 | 0.798 | 0.790 |
| hitting feeling | 5 | 4 | 3 | 5 | 3 |

*1 corresponding to the distance between the ribbed part and the lower edge of the face portion measured at the vertical plane 1 V.

The invention claimed is:

1. A golf club head having a hollow therein and comprising a face portion having a club face for hitting a ball, a sole portion continuing to a lower edge of the face portion and defining a bottom face of the club head, and a hosel portion comprising a hosel into which a tip end of a golf club shaft is inserted, wherein the hosel protrudes into the hollow, the sole portion is provided in its club face side with a thick ribbed part, the ribbed part swells toward the hollow, and has a thickness of from 3.0 to 10.0 mm, and the ribbed part is extended in the toe-heel direction of the head, and in the hollow, the ribbed part is connected to the hosel, wherein the ribbed part is formed within a range of 3 to 15 mm from a vertical plane VP toward the front direction and toward the back direction of the head.

2. The golf club head according to claim 1, wherein the hosel comprises a tubular main portion and a bottom portion closing the lower end of the tubular main portion within the hollow, and the ribbed part is connected to the bottom portion of the hosel.

3. The golf club head according to claim 1, wherein the ribbed part is separated from the back surface of the face portion facing the hollow.

4. A golf club head having a hollow therein and comprising a face portion having a club face for hitting a ball, a sole portion continuing to a lower edge of the face portion and defining a bottom face of the club head, and a hosel portion comprising a hosel into which a tip end of a golf club shaft is inserted, wherein the hosel protrudes into the hollow, the sole portion is provided in its club face side with a thick ribbed part, the ribbed part swells toward the hollow, and has a thickness of from 3.0 to 10.0 mm, and the ribbed part is extended in the toe-heel direction of the head, and in the hollow, the ribbed part is connected to the hosel, and wherein in the toe-heel direction, the maximum thickness of the ribbed part occurs at a vertical plane 1V passing through the center of gravity of the head perpendicularly to a vertical plane VP.

5. The golf club head according to claim 4, wherein the hosel comprises a tubular main portion and a bottom portion closing the lower end of the tubular main portion within the hollow, and the ribbed part is connected to the bottom portion of the hosel.

6. The golf club head according to claim 4, wherein the ribbed part is separated from the back surface of the face portion facing the hollow.

7. A golf club head having a hollow therein and comprising a face portion having a club face for hitting a ball, a sole portion continuing to a lower edge of the face portion and defining a bottom face of the club head, and a hosel portion comprising a hosel into which a tip end of a golf club shaft is inserted, wherein the hosel protrudes into the hollow, the sole portion is provided in its club face side with a thick ribbed part, the ribbed part swells toward the hollow, and has a thickness of from 3.0 to 10.0 mm, and the ribbed part is extended in the toe-heel direction of the head, and in the hollow, the ribbed part is connected to the hosel, and wherein the thickness of the ribbed part is gradually decreased toward the rear side of the club head.

8. The golf club head according to claim 7, wherein the hosel comprises a tubular main portion and a bottom portion closing the lower end of the tubular main portion within the hollow, and the ribbed part is connected to the bottom portion of the hosel.

9. The golf club head according to claim 7, wherein the ribbed part is separated from the back surface of the face portion facing the hollow.

* * * * *